US010456624B2

(12) United States Patent
Brown et al.

(10) Patent No.: US 10,456,624 B2
(45) Date of Patent: Oct. 29, 2019

(54) SYSTEM AND METHOD FOR PERFORMING EXERCISE TESTING AND TRAINING

(71) Applicant: THE UAB RESEARCH FOUNDATION, Birmingham, AL (US)

(72) Inventors: David A. Brown, Hoover, AL (US); Christopher Hurt, Birmingham, AL (US); Marcas Bamman, Hoover, AL (US)

(73) Assignee: THE UAB RESEARCH FOUNDATION, Birmingham, AL (US)

( * ) Notice: Subject to any disclaimer, the term of this patent is extended or adjusted under 35 U.S.C. 154(b) by 0 days.

(21) Appl. No.: 15/504,676

(22) PCT Filed: Aug. 25, 2015

(86) PCT No.: PCT/US2015/046666
§ 371 (c)(1),
(2) Date: Feb. 17, 2017

(87) PCT Pub. No.: WO2016/033024
PCT Pub. Date: Mar. 3, 2016

(65) Prior Publication Data

US 2017/0274248 A1 Sep. 28, 2017

Related U.S. Application Data

(60) Provisional application No. 62/041,194, filed on Aug. 25, 2014.

(51) Int. Cl.
*A63B 24/00* (2006.01)
*A63B 69/00* (2006.01)
(Continued)

(52) U.S. Cl.
CPC ..... *A63B 24/0062* (2013.01); *A63B 21/0058* (2013.01); *A63B 21/00181* (2013.01);
(Continued)

(58) Field of Classification Search
None
See application file for complete search history.

(56) References Cited

U.S. PATENT DOCUMENTS 5,242,339 A 9/1993 Thornton
5,372,561 A * 12/1994 Lynch ..... A63B 69/0064 482/54

(Continued)

FOREIGN PATENT DOCUMENTS

EP 2813267 A1 12/2014

OTHER PUBLICATIONS

International Search Report for PCT/US2015/046666 dated Jan. 12, 2016.

(Continued)

*Primary Examiner* — Stephen R Crow
(74) *Attorney, Agent, or Firm* — Thomas Horstemeyer, LLP

(57) ABSTRACT

Disclosed are various approaches for determining the maximum oxygen consumption of a person, also known as maximum aerobic capacity or $VO_2$ Max. A person is positioned on a treadmill. Attached to the person is a harness configured to apply a horizontal force to the person. A work rate for the person can be calculated based at least in part on the magnitude of the horizontal force applied by the harness and the velocity of the belt. The maximum oxygen consumption for the person can then be calculated based at least in part on the previously calculated work rate.

11 Claims, 11 Drawing Sheets

(51) Int. Cl.

| | |
|---|---|
| ***A63B 21/005*** | (2006.01) |
| ***A63B 21/055*** | (2006.01) |
| ***A63B 21/00*** | (2006.01) |
| ***A63B 22/02*** | (2006.01) |
| ***A63B 23/04*** | (2006.01) |

(52) U.S. Cl.

CPC ..... *A63B 21/0552* (2013.01); *A63B 21/154* (2013.01); *A63B 21/4009* (2015.10); *A63B 22/0242* (2013.01); *A63B 23/047* (2013.01); *A63B 24/0087* (2013.01); *A63B 69/0057* (2013.01); *A63B 2022/0278* (2013.01); *A63B 2024/0093* (2013.01); *A63B 2220/17* (2013.01); *A63B 2220/30* (2013.01); *A63B 2225/50* (2013.01); *A63B 2230/01* (2013.01); *A63B 2230/062* (2013.01); *A63B 2230/305* (2013.01); *A63B 2230/425* (2013.01); *A63B 2230/505* (2013.01)

(56) References Cited

U.S. PATENT DOCUMENTS

| | | | | |
|---|---|---|---|---|
| 5,839,993 | A * | 11/1998 | Fox | A63B 22/02 482/54 |
| 6,287,240 | B1 | 9/2001 | Trabbic | |
| 6,394,933 | B1 * | 5/2002 | Yu | A63B 22/02 482/54 |
| 6,454,679 | B1 * | 9/2002 | Radow | A63B 22/0235 482/4 |
| 6,575,876 | B1 | 6/2003 | Phelps-McMillon | |
| 6,666,831 | B1 * | 12/2003 | Edgerton | A61H 1/0237 600/587 |
| 6,676,569 | B1 * | 1/2004 | Radow | A63B 22/0235 482/4 |
| 6,837,830 | B2 * | 1/2005 | Eldridge | A63B 21/157 482/54 |
| 7,125,388 | B1 * | 10/2006 | Reinkensmeyer | A63B 69/0064 601/5 |
| 7,381,163 | B2 * | 6/2008 | Gordon | A63B 22/02 482/69 |
| 7,645,215 | B2 * | 1/2010 | Gordon | A63B 21/155 482/51 |
| 7,780,573 | B1 | 8/2010 | Carmein | |
| 8,152,699 | B1 | 4/2012 | Ma et al. | |
| 8,460,162 | B2 * | 6/2013 | Park | A61H 1/0262 482/1 |
| 8,968,163 | B1 * | 3/2015 | Vidmar | A61H 3/008 482/43 |
| 9,364,735 | B2 * | 6/2016 | Beane | A63B 69/0064 |
| 9,498,696 | B1 * | 11/2016 | Razon | A63B 71/0009 |
| 9,675,838 | B2 * | 6/2017 | Manzke | A63B 21/00069 |
| 9,713,439 | B1 * | 7/2017 | Wu | A61B 5/112 |
| 2005/0054938 | A1 | 3/2005 | Wehman et al. | |
| 2006/0229167 | A1 | 10/2006 | Kram et al. | |
| 2009/0215588 | A1 * | 8/2009 | Riener | A61H 1/0237 482/7 |
| 2011/0118090 | A1 | 5/2011 | Ellis | |
| 2016/0001119 | A1 * | 1/2016 | Jue | A63B 69/0064 482/54 |
| 2016/0325131 | A1 * | 11/2016 | Wehrell | A63B 21/0442 |
| 2017/0027803 | A1 * | 2/2017 | Agrawal | A61B 5/6828 |
| 2017/0128769 | A1 * | 5/2017 | Long | A63B 21/00181 |
| 2018/0043206 | A1 * | 2/2018 | Crist | A63B 69/0057 |
| 2018/0085278 | A1 * | 3/2018 | Maekita | A61H 1/0229 |
| 2018/0221235 | A1 * | 8/2018 | Daba | A61H 1/0262 |

OTHER PUBLICATIONS

Hurt, et al., "A novel approach to testing maximum aerobic capacity: the use of horizontal resistive forces", presented in Chicago on Aug. 26, 2014, 11 pages.

Capo-Lugo C, Mullens, C, Brown DA: Maximum walking speeds obtained using treadmill and overground robot system in persons with post-stroke hemiplegia. J. Neuroeng Rehabil. Oct. 11, 2012;9:80. doi: 10.1186/1743-0003-9-80.

Burgess JK, Weibel GC, Brown DA: Overground walking speed changes when subjected to body weight support conditions for nonimpaired and post stroke individuals. J Neural Engr Rehab 7:6, 2010. PMID: 20149244.

Breger, J, Collins N, Deshpande A, Johnston L, LeJeune J, Palit P, Potter K, Hedman L, Brown DA: Validity of the K-9 & BESTest balance measures in community-dwelling stroke survivors. 2012 Combined Sections Meeting of the APTA, Chicago, IL, Abstract on p. 61, of "Abstracts, CSM 2012 Chicago, Neurology Section Poster Presentations".

Capo-Lugo CE, Mullens C, Brown DA: Maximum walking speeds obtained using treadmill and overground robotic system in persons with post-stroke hemiplegia. 2012 Combined Sections Meeting of the APTA, Chicago, IL. Abstract on p. 73, of "Abstracts, CSM 2012 Chicago, Neurology Section Poster Presentations".

Anand I, Bell S, Kerzee-Stames A, Logan, J, Schmidt K, Brown DA: Individuals post-stroke walk faster with body weight support on a challenging, compliant surface. 2011 Combined Sections Meeting of the APTA, New Orleans, LA.

Foster LW, Goodlow K, Brown DA, Lewis E, Roth E, McKenna V, Alexander A, Berkowitz M: Gait and balance training in stroke subjects utilizing the KineAssistal®. 2011 Combined Sections Meeting of the APTA, New Orleans, LA.

Diaz I, Gil JJ, and Sanchez E: Lower-Limb Robotic Rehabilitation: Literature Review and Challenges. Journal of Robotics. 2011. doi: 10.1155/2011/759764.

* cited by examiner

SYSTEM AND METHOD FOR PERFORMING EXERCISE TESTING AND TRAINING

CROSS-REFERENCE TO RELATED APPLICATION

This application is the 35 U.S.C. § 371 national stage application of PCT Application No. PCT/US2015/046666, filed Aug. 25, 2015, where the PCT claims priority to and the benefit of, U.S. Provisional Application No. 62/041,194, filed Aug. 25, 2014, both of which are herein incorporated by reference in their entireties.

BACKGROUND

Individuals have a maximum limit for the amount of oxygen that can be absorbed into the bloodstream. This level is referred to by various terms, such as peak aerobic capacity, maximum oxygen capacity, or $VO_2$ Max. A number of methods exist for eliciting peak aerobic capacity.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

SUMMARY

Figure 1:
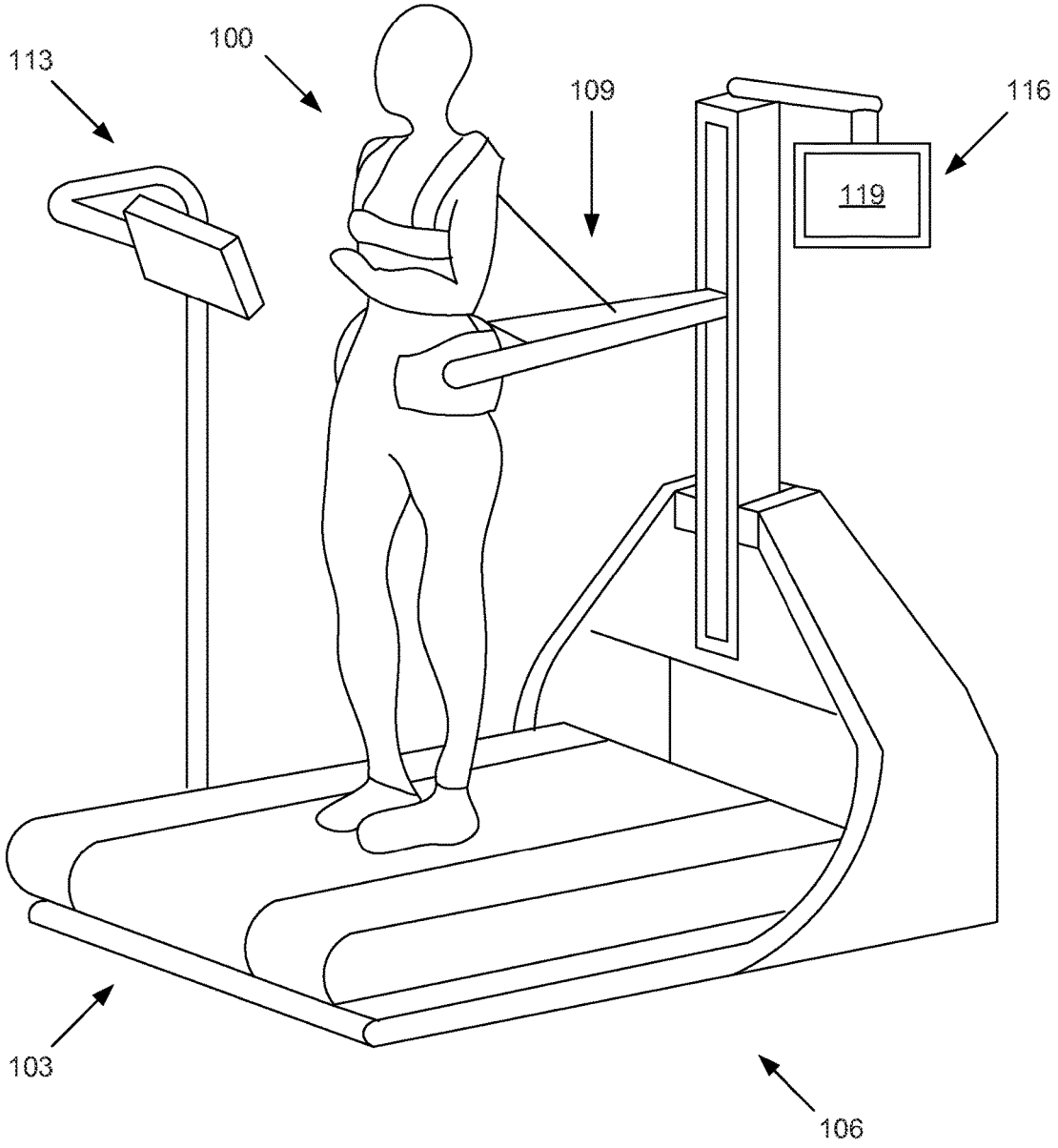
FIG. 1 is a drawing of a system for eliciting aerobic capacity of a person according to various embodiments of the present disclosure.

Disclosed is a system that includes a treadmill; a harness configured to transfer a constant horizontal force to a person on the treadmill, wherein a magnitude of the constant horizontal force has been previously selected for the person; a computing device in data communication with the treadmill and the harness, wherein the computing device is configured to at least: identify a velocity of a belt of the treadmill; identify a mass of the person; and calculate a work rate for the person on the treadmill based at least in part on the velocity of the belt and the mass of the person. In some embodiments, the computing device is further configured to calculate a maximum oxygen consumption of the person on the treadmill based at least in part on the work rate. In some embodiments of the system, comprises an apparatus configured to permit the person to select the velocity of the belt. In some embodiments, the harness is connected to a motor that applies a constant force by a traction line. In some embodiments, the harness is connected to a lever arm, wherein a weight is suspended from the lever arm. In some embodiments, the harness is connected to an elastic line configured to develop the constant horizontal force as the elastic line is stretch. In some embodiments, the elastic line is threaded around a pulley mounted to a frame of the treadmill.

Disclosed is a method that includes determining a velocity of a belt of the treadmill; determining a mass of the person on the treadmill; and calculating a work rate for the person on the belt of the treadmill based at least in part on the mass of the person and the velocity of the belt of the treadmill. In some embodiments, the method further comprises calculating a maximum oxygen consumption of the person on the treadmill based at least in part on the calculated work rate and a duration of time spent by the person on the belt of the treadmill. The method can further include determining that the calculated work rate fails to result in a prescribed workout intensity; and adjusting the velocity of the belt in response to determining that the calculated work rate fails to match the prescribed workout intensity. The method can also include determining that the calculated work rate fails to result in a prescribed workout intensity; and adjusting the magnitude of the horizontal force in response to determining that the calculated work rate fails to match the prescribed workout intensity.

Disclosed is an apparatus including a treadmill; a frame connected to the treadmill; a harness; and a line coupled to the harness, wherein the line is configured to develop a horizontal force on the harness. The apparatus can further include a lever arm; a weight suspended from the lever arm, wherein the weight is configured to be slid along the lever arm; and wherein the line is further coupled to the lever arm. The apparatus can further include a motor that applies a constant force, wherein the line is further coupled to the motor that applies the constant force. In some embodiments of the apparatus, the line is anchored to the base of the treadmill and the line is elastic, such that as the line is stretched, additional force is applied to the harness.

DETAILED DESCRIPTION

Disclosed are various embodiments of a system and method for assessing the peak aerobic capacity, also known as maximum oxygen capacity or or $VO_2$ Max. Individuals are placed on a treadmill and are secured by a harness. The harness applies a horizontal force to the individual to increase or decrease the difficulty of moving at the speed of the belt of the treadmill. The harness and attached frame include a backstop to prevent an individual from falling off the back of the treadmill and further prevents an individual from falling to the treadmill surface if they should lose their balance. These safety mechanisms do not blunt the physiologic response to the testing or exercise training. The speed of the treadmill can be selected by the individual on the treadmill. This allows individuals who are at a lower level of fitness or individuals with physical disabilities to select an appropriate speed for their particular level of fitness or physical abilities. In the following discussion, a general description of the system and its components is provided, followed by a discussion of the operation of the same.

With reference to FIG. 1, shown is a system for eliciting peak aerobic capacity or maximum oxygen consumption of a person 100, according to various embodiments of the present disclosure. The person 100 is positioned on a belt 103 of a treadmill 106. The person 100 is then fitted to a harness 109. Coupled to the treadmill 106 is an input device 113. In data communication with the treadmill 106, the harness 109, and/or the input device 113 is a computing device 116. Although the computing device 116 is depicted as being physically attached to the treadmill 106, the computing device 116 can be a separate device from the treadmill 106 in some embodiments of the present disclosure. In such embodiments, the computing device 116 can be in data communication with the treadmill 106, the harness 109, and/or the input device 113 by means of a data cable, such as serial cable, Ethernet cable, or similar connection, or by means of a wireless connection, such as a Bluetooth® connection or a Wi-Fi® connection.

The belt 103 permits the person 100 to move in place on the treadmill 106. The belt 103 can move at any one of a number of velocities, which can or cannot be specified by the person 100.

The harness 109 can be configured to apply horizontal forces to the person 100. For example, the harness 109 can provide a resistive horizontal force to increase the effort required of the person 100 to maintain a speed corresponding to the velocity of the belt 103. As another example, the harness 109 can provide an assistive force to decrease the effort required of the person 100 to maintain a speed corresponding to the velocity of the belt 103. The harness 109 can further be configured, in some embodiments to measure and/or otherwise record the magnitude of the assistive or resistive force applied to the person 100. When a resistive force is applied, the resistive force must be applied to a different location on the user than via resistance to the belt 103.

The harness 109 also provides safety assistance, particularly for those persons 100 who have a gait or balance impairment, such as physically disabled persons 100 or persons 100 who are in physical therapy and have reduced balance, motor control, coordination, or other impairments. By using a harness, instead of handrails or similar devices, the physiologic response of the person 100 to the test is not reduced, thereby avoiding an overestimation of the peak aerobic capacity ($VO_2$ Max) of the individual. Further, the harness 109 prevents the person 100 from falling in the event that the person stumbles, trips, or suffers a similar mishap. The harness system 109 includes an element that acts to prevent an individual from falling to the treadmill surface 103 if they should lose their balance.

The input device 113 allows the person 100 to select the desired velocity for the belt 103. The input device 113 can include a touchscreen input, keyboard, keypad, and/or other input device allowing the person 100 to specify their desired velocity for the belt 103.

The computing device 116 can comprise, for example, a processor-based system such as a computer system. Such a computer system can be embodied in the form of a desktop computer, a laptop computer, personal digital assistants, cellular telephones, smartphones, set-top boxes, music players, web pads, tablet computer systems, game consoles, electronic book readers, or other devices with like capability. The computing device 116 can include a display 119. The display 119 can comprise, for example, one or more devices such as liquid crystal display (LCD) displays, gas plasma-based flat panel displays, organic light emitting diode (OLED) displays, electrophoretic ink (E-ink) displays, LCD projectors, or other types of display devices, etc. In some embodiments, the computing device 116 can be a component of the treadmill 106, such as in the embodiment depicted in FIG. 1, or can be a separate component of the system. In those embodiments where the computing device 116 is a separate component, the computing device 116 can still be in data communications with the treadmill 106 by means of a data cable, such as serial cable, Ethernet cable, or similar connection, or by means of a wireless connection, such as a Bluetooth® connection or a Wi-Fi® connection.

Figure 2A:
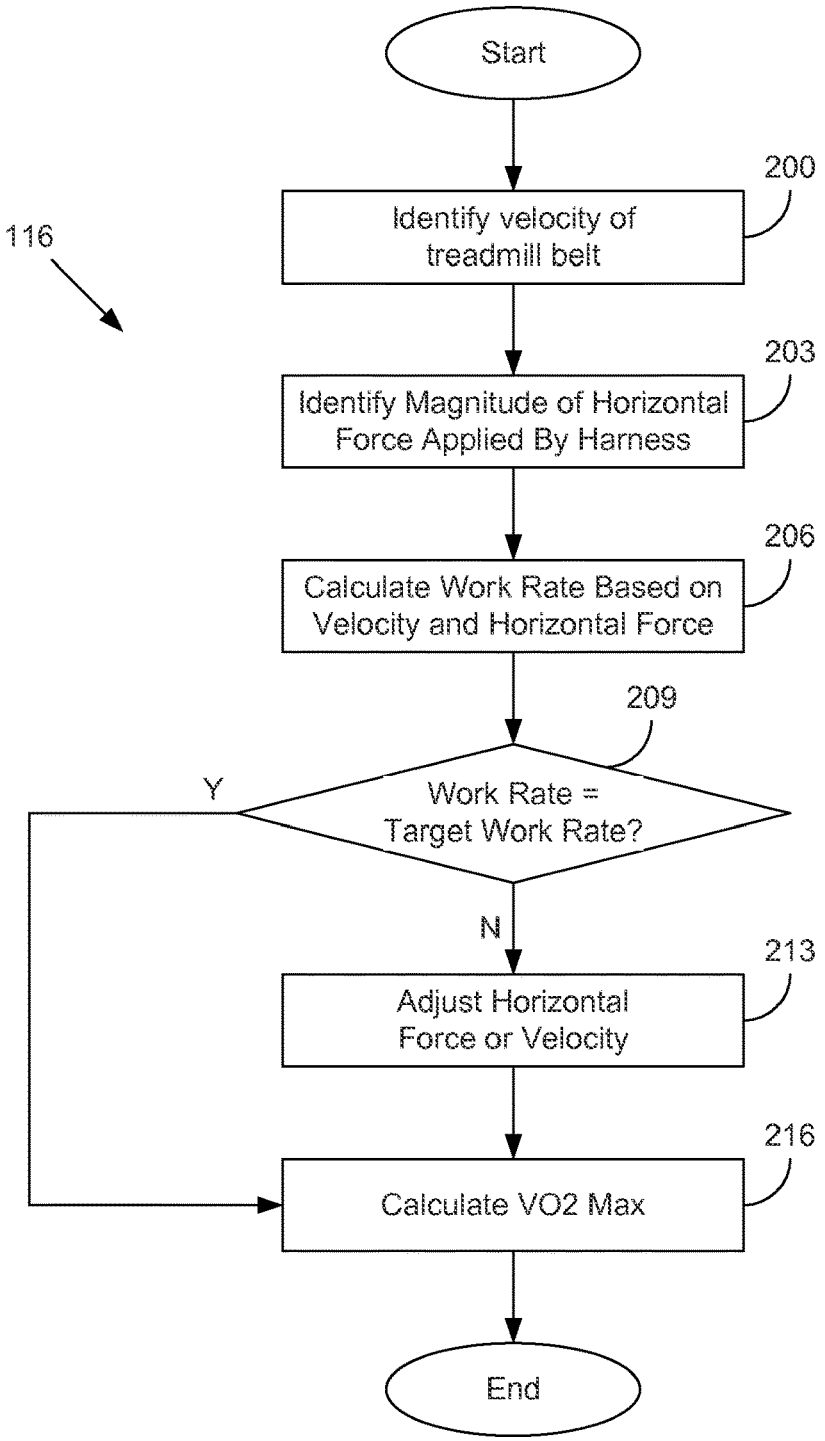
FIG. 2A and FIG. 2B are flowcharts illustrating one example of functionality implemented as portions of a computing device depicted in the system of FIG. 1 according to various embodiments of the present disclosure.

Referring next to FIG. 2A, shown is a flowchart that provides one example of the operation of a portion of the computing device 116 or an application executed by the computing device 116 according to various embodiments. It is understood that the flowchart of FIG. 2A provides merely an example of the many different types of functional arrangements that can be employed to implement the operation of the portion of the computing device 116 or an application executed by the computing device 116, as described herein. As an alternative, the flowchart of FIG. 2A can be viewed as depicting an example of elements of a method implemented in the computing device 116 according to one or more embodiments.

Beginning with box 200, the computing device 116 identifies or determines the velocity of the belt 103 (FIG. 1) of the treadmill 106 (FIG. 1). In some embodiments, the velocity can be reported to the computing device 116 by the treadmill 106. In other embodiments, data, such as revolutions per minute of the motor moving the belt 103, can be reported to the computing device 116. The velocity of the belt 103 can be derived from such data. For example, based at least in part on such factors as the number of revolutions per minute that the motor driving the belt 103 is operating at and the length of the belt 103, the velocity of the belt 103 can be calculated.

Proceeding next to box 203, the computing device 116 identifies or determines the magnitude of the horizontal force applied by the harness 109 (FIG. 1) to the person 100 (FIG. 1). In some embodiments, the magnitude of the horizontal force can be reported to the computing device 116 by the harness 109. In other embodiments, the computing device can make use of a sensor reading indicating the magnitude of horizontal force applied by the harness 109 to the person 100. In such embodiments, the computing device 116 can query the sensor or the sensor can regularly report readings of the magnitude of the horizontal force applied by the harness 109 to the person 100.

Moving on to box 206, the computing device 116 calculates a work rate for the person 100 based at least in part on the velocity of the treadmill belt 103 and the magnitude of the horizontal force applied by the harness 109 to the person. Work rate can be calculated, for example, using the standard formula:

$$\text{Work Rate}=m*g*\sin(\theta)*v$$

Where m is the body mass of the individual; g is the acceleration due to gravity; theta represents the angle of the treadmill from the horizon; and v is the velocity of the treadmill belt. The horizontal force to be applied to an individual can be calculated by:

$$\text{Horizontal Resistive Force} = \frac{\text{Work Rate}}{v_{selected}}$$

Where $v_{selected}$ is the individual's self-selected walking speed. In order for the $v_{selected}$ to remain constant, the horizontal force should be applied to a different location on the user than via resistance to the treadmill belt. Increasing the resistive force, for example with a braking apparatus, applied through the treadmill belt results in the user decreasing their overall walking speed. However, in order for an individual to achieve a specified work rate, the user must maintain a constant walking speed while the resistive force is applied. Applying the resistive force to the user, while controlling the treadmill belt at a constant (and known) velocity, enables achievement of a specific work rate.

Referring next to box 209, the computing device 116 verifies that the calculated work rate matches an expected work rate for the protocol being modeled. For example, the Bruce Protocol for eliciting peak aerobic activity, which requires an individual to walk on a treadmill until exhaustion as the treadmill speed and incline are increased every three minutes, has a mass specific Work Rate for each stage of the protocol. The work rates for 100 kg individual performing 5 stages of the Bruce Protocol is provided in Table 1 below:

| Stage | Velocity (m/s) | Grade (radian) | Mass (kg) | Work Rate (J) |
|---|---|---|---|---|
| 1 | 0.76 | 0.10 | 100 | 74 |
| 2 | 1.12 | 0.12 | 100 | 130 |
| 3 | 1.52 | 0.14 | 100 | 207 |
| 4 | 1.89 | 0.16 | 100 | 291 |
| 5 | 2.24 | 0.18 | 100 | 388 |

If the Bruce Protocol is being modeled, then the computing device 116 would verify that the horizontal force being applied to the individual and the velocity for the treadmill are sufficient to match the work rates provided above. For example, if the 100 kg individual were to select a walking speed of 1.3 m/s, then horizontal forces necessary to replicate the physiological effects of the Bruce Protocol would be those forces listed in the table below:

| Stage | Target Work Rate (J) | Velocity (m/s) | Horizontal Force (N) |
|---|---|---|---|
| 1 | 74 | 1.3 | 57 |
| 2 | 130 | 1.3 | 100 |
| 3 | 207 | 1.3 | 159 |
| 4 | 291 | 1.3 | 224 |
| 5 | 388 | 1.3 | 298 |

Moving on to box 213, the computing device 116 adjusts the horizontal force being applied or the selected velocity if the target work rate does not match the calculated work rate. For example, the computing device 116 can adjust the horizontal force if the individual changed their selected speed.

Proceeding next to box 216, the computing device 116 calculates the peak aerobic capacity, also known as maximum oxygen capacity or $VO_2$ Max. For example, if the Bruce Protocol were being modeled, then peak aerobic capacity can be estimated using the following formula for men:

$$VO2\ \text{Max} = 14.8 - (1.379 * T) + (0.451 * T^2) - (0.012 * T^3)$$

and the following formula for women:

$$VO2\ \text{Max} = 4.38 * T - 3.9$$

where T is the total time on the treadmill measured as a fraction of a minute. Other formulas can be used if other protocols are being modeled. Other $VO_2$ Max estimations can also be used in place of the Bruce Protocol, and they can vary depending on what testing protocol is utilized and the age/sex of the individual. After the peak aerobic capacity is calculated, execution subsequently ends.

Figure 2B:
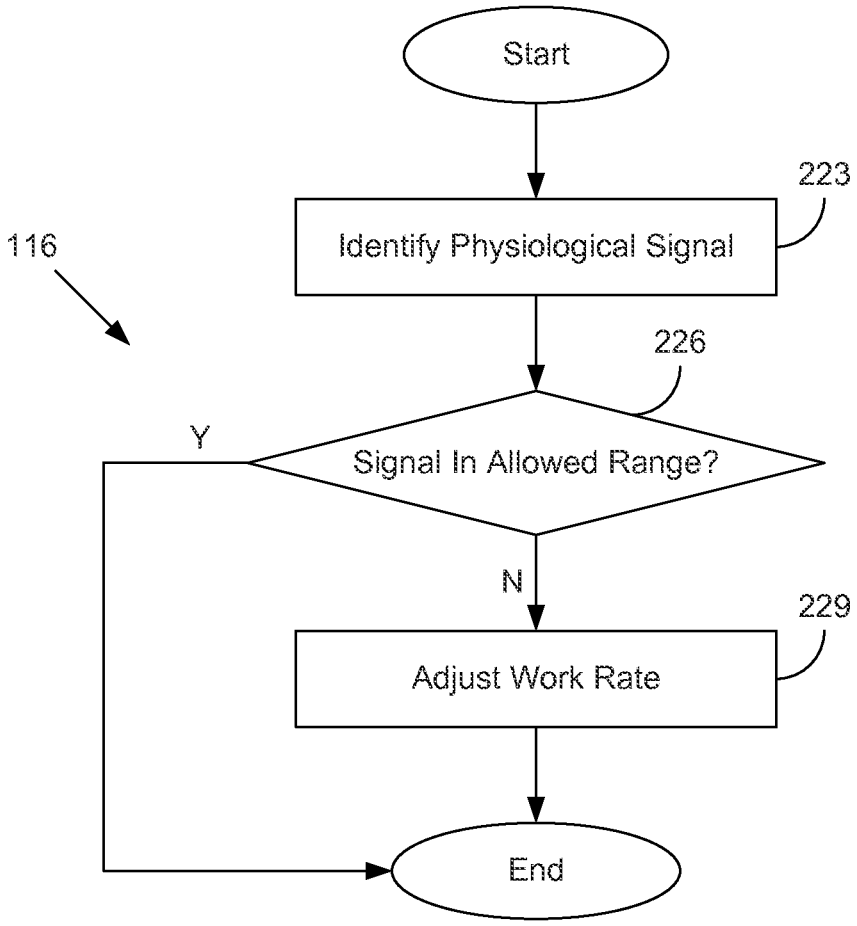

Referring next to FIG. 2B, shown is a flowchart that provides one example of the operation of a portion of the computing device 116 or an application executed by the computing device 116 according to various embodiments. It is understood that the flowchart of FIG. 2B provides merely an example of the many different types of functional arrangements that can be employed to implement the operation of the portion of the computing device 116 or an application executed by the computing device 116, as described herein. As an alternative, the flowchart of FIG. 2B can be viewed as depicting an example of elements of a method implemented in the computing device 116 according to one or more embodiments.

Beginning with step 223, the computing device 116 identifies a physiological signal. Examples of physiological signals include heart rate, breathing rate, temperature, blood pressure, or similar vital signs. For example, the computing device 116 may receive the heart rate or pulse from a heart rate monitor affixed to the individual, the temperature from a thermometer affixed to the individual, blood pressure from a blood pressure gauge or monitor, and breathing rate from breathing rate monitor.

Moving on to step 226, the computing device determines if the identified physiological signal falls within an expected, allowed, or prescribed range. For example, an individual undergoing a cardiac stress test may have a target heart rate range of 135-165 beats per minute. If the heart rate identified at step 223 is less than 135, this could indicate that the work rate is too low. If the heart rate identified at step 223 is more than 165, it could indicate that the work rate is too high. If the physiological signal is within the prescribed range, execution ends. However, if the physiological signal is outside the prescribed range, then execution proceeds to step 229.

At step 229, the computing device causes the treadmill 103 (FIG. 1) to adjust one or more settings. For example, if the target heart rate is too low, the computing device 116 can cause the speed of the treadmill to increase or the amount of horizontal force applied to the individual to be increased. Similarly, if the target heart rate is too high, the computing device 116 can cause the speed of the treadmill to decrease or the amount of horizontal force applied to the individual to be decreased. After adjusting the speed or force, execution ends.

Figure 3:
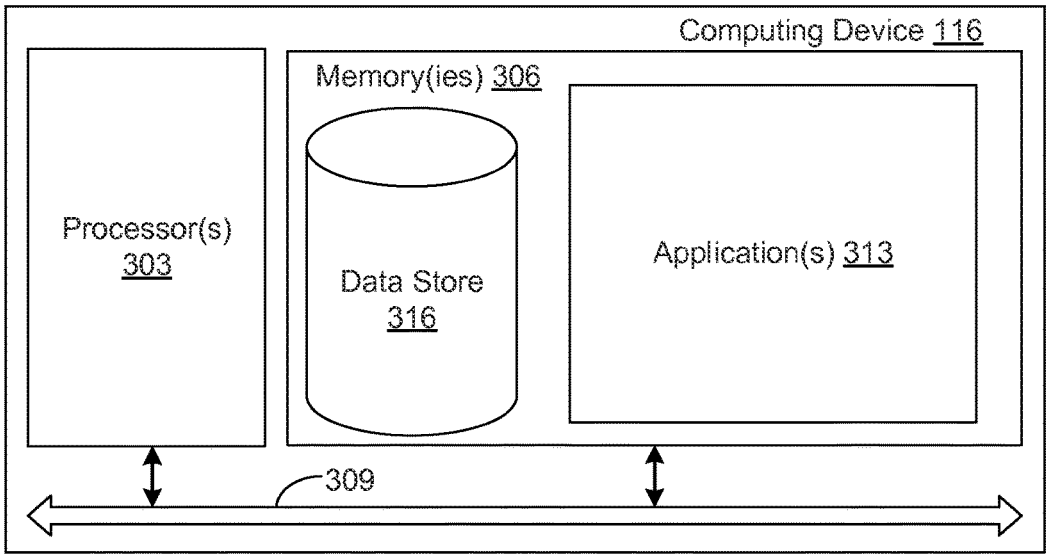
FIG. 3 is a schematic block diagram that provides one example illustration of the computing device depicted in the system of FIG. 1 according to various embodiments of the present disclosure.

With reference to FIG. 3, shown is a schematic block diagram of the computing device 116 according to an embodiment of the present disclosure. The computing device 116 includes at least one processor circuit, for example, having a processor 303 and a memory 306, both of which are coupled to a local interface 309. To this end, each computing device 116 can comprise, for example, at least one server computer or like device. The local interface 309 can comprise, for example, a data bus with an accompanying address/control bus or other bus structure as can be appreciated.

Stored in the memory 306 are both data and several components that are executable by the processor 303. In particular, stored in the memory 306 and executable by the processor 303 are one or more applications 313, and potentially other applications. Also stored in the memory 306 can be a data store 316 and other data. In addition, an operating system can be stored in the memory 306 and executable by the processor 303.

It is understood that there can be other applications that are stored in the memory 306 and are executable by the processor 303 as can be appreciated. Where any component discussed herein is implemented in the form of software, any one of a number of programming languages can be employed such as, for example, C, C++, C#, Objective C, Java®, JavaScript®, Perl, PHP, Visual Basic®, Python®, Ruby, Flash®, or other programming languages.

A number of software components are stored in the memory 306 and are executable by the processor 303. In this respect, the term "executable" means a program file that is in a form that can ultimately be run by the processor 303. Examples of executable programs can be, for example, a compiled program that can be translated into machine code in a format that can be loaded into a random access portion of the memory 306 and run by the processor 303, source code that can be expressed in proper format such as object code that is capable of being loaded into a random access portion of the memory 306 and executed by the processor 303, or source code that can be interpreted by another executable program to generate instructions in a random access portion of the memory 306 to be executed by the processor 303, etc. An executable program can be stored in any portion or component of the memory 306 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 306 is defined herein as including both volatile and nonvolatile memory and data storage components. Volatile components are those that do not retain data values upon loss of power. Nonvolatile components are those that retain data upon a loss of power. Thus, the memory 306 can comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM can comprise, for example, static random access memory (SRAM), dynamic random access memory (DRAM), or magnetic random access memory (MRAM) and other such devices. The ROM can comprise, for example, a programmable read-only memory (PROM), an erasable programmable read-only memory (EPROM), an electrically erasable programmable read-only memory (EEPROM), or other like memory device.

Also, the processor 303 can represent multiple processors 303 and/or multiple processor cores and the memory 306 can represent multiple memories 306 that operate in parallel processing circuits, respectively. In such a case, the local interface 309 can be an appropriate network that facilitates communication between any two of the multiple processors 303, between any processor 303 and any of the memories 306, or between any two of the memories 306, etc. The local interface 309 can comprise additional systems designed to coordinate this communication, including, for example, performing load balancing. The processor 303 can be of electrical or of some other available construction.

Although the one or more applications 313, and other various systems described herein can be embodied in software or code executed by general purpose hardware as discussed above, as an alternative the same can also be embodied in dedicated hardware or a combination of software/general purpose hardware and dedicated hardware. If embodied in dedicated hardware, each can be implemented as a circuit or state machine that employs any one of or a combination of a number of technologies. These technologies can include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowchart of FIG. 2 shows the functionality and operation of an implementation of portions of the computing device 116 and/or the one or more applications 313 executed by the computing device 116. If embodied in software, each block can represent a module, segment, or portion of code that comprises program instructions to implement the specified logical function(s). The program instructions can be embodied in the form of source code that comprises human-readable statements written in a programming language or machine code that comprises numerical instructions recognizable by a suitable execution system such as a processor 303 in a computer system or other system. The machine code can be converted from the source code, etc. If embodied in hardware, each block can represent a circuit or a number of interconnected circuits to implement the specified logical function(s).

Although the flowchart of FIG. 2A and FIG. 2B shows a specific order of execution, it is understood that the order of execution can differ from that which is depicted. For example, the order of execution of two or more blocks can be scrambled relative to the order shown. Also, two or more blocks shown in succession in FIG. 2A and FIG. 2B can be executed concurrently or with partial concurrence. Further, in some embodiments, one or more of the blocks shown in FIG. 2A and FIG. 2B can be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the one or more applications 313, that comprises software or code can be embodied in any non-transitory computer-readable medium for use by or in connection with an instruction execution system such as, for example, a processor 303 in a computer system or other system. In this sense, the logic can comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium can be a random access memory (RAM) including, for example, static random access memory (SRAM) and dynamic random access memory (DRAM), or magnetic random access memory (MRAM). In addition, the computer-readable medium can be a read-only memory (ROM), a programmable read-only memory (PROM), an erasable programmable read-only memory (EPROM), an electrically erasable programmable read-only memory (EEPROM), or other type of memory device.

Further, any logic or application described herein, including the one or more applications 313, can be implemented and structured in a variety of ways. For example, one or more applications described can be implemented as modules or components of a single application. Further, one or more applications described herein can be executed in shared or separate computing devices or a combination thereof. For example, a plurality of the applications described herein can execute in the same computing device 116. Additionally, it is understood that terms such as "application," "service," "system," "engine," "module," and so on can be interchangeable and are not intended to be limiting.

In addition to the embodiments described above, non-computerized approaches can be employed to similarly determine the peak aerobic capacity ($VO_2$ Max) of an individual. In these embodiments, one can mechanically apply a horizontal force to the individual, preferentially at the individual's center of mass (although applying the horizontal force at other positions is also possible). The treadmill can then be set to a specified speed. Because the values of the speed of the treadmill and the horizontal force are known, one can calculate the target Work Rate for a protocol being modeled (e.g. the Bruce Protocol) without the need of a computing device using the formula. For a standard exercise testing protocol, the formula to estimate the amount of mechanical work a person performs is:

$$\text{Work Rate}=m*g*\sin(\theta)*v$$

Where m is the body mass of the individual; g is the acceleration due to gravity; theta represents the angle of the treadmill from the horizon; and v is the velocity of the treadmill belt. The horizontal resistive force to be applied to an individual can be calculated by:

$$\text{Horizontal Resistive Force} = \frac{\text{Work Rate}}{v_{selected}}$$

Where $v_{selected}$ is the individual's self-selected walking speed. The Work Rate can also be varied by changing the horizontal force applied to the individual without a change to the treadmill speed. Various example embodiments utilizing these techniques are described below.

Figure 4A:
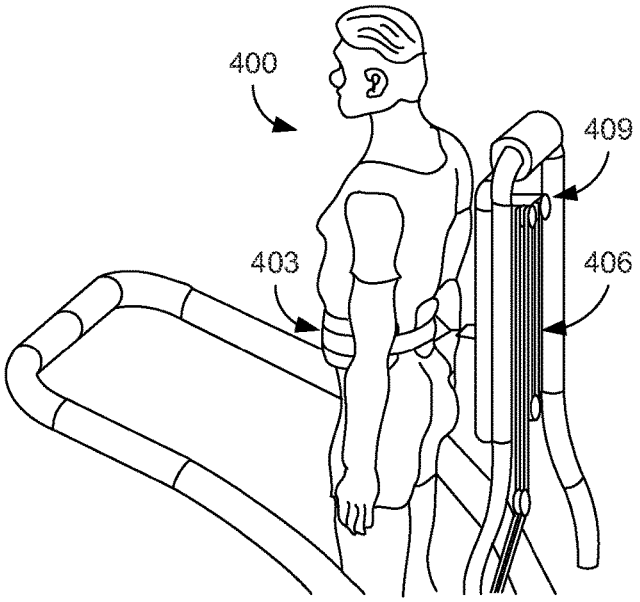
FIG. 4A and FIG. 4B are drawings of an alternative embodiment of the present disclosure.

Moving on to FIG. 4A, shown is another embodiment of the present disclosure for eliciting peak aerobic capacity or maximum oxygen consumption of a person 400. The person 400 is positioned on a belt of a treadmill. The person 400 is then fitted to a harness 403. Coupled to the harness are one or more elastic lines 406 made of rubber or a similar elastic material. The elastic lines 406 can be threaded through one or more pulleys 409 and anchored at the base of the treadmill. Each line can be tightened or stretched to develop force that is to be applied horizontally to the individual 400. By tightening one or more of the elastic lines 406, the desired force can be applied to the individual 400.

Figure 4B:
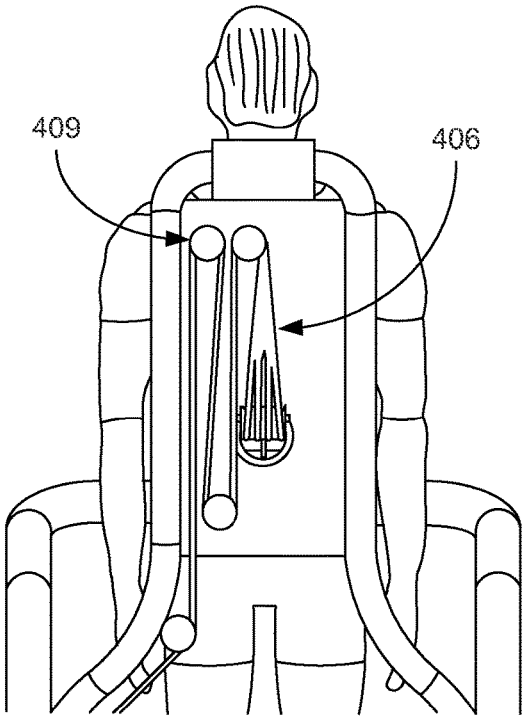

FIG. 4B depicts another view of the embodiment depicted in FIG. 4A and described above. Here, one example of the arrangement of the elastic lines 406 and pulleys 409 is depicted. Other arrangements are possible and can be utilized in various other examples or instances of the present disclosure.

Figure 5A:
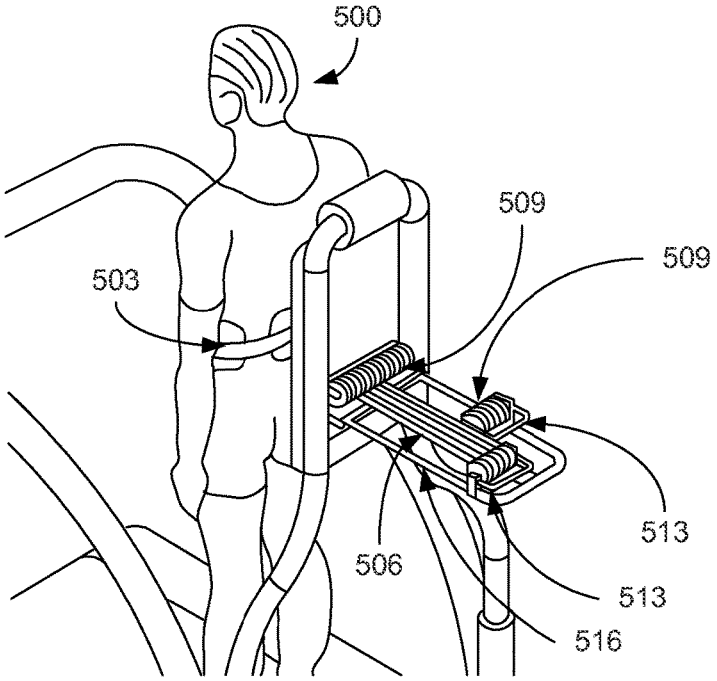
FIG. 5A and FIG. 5B are drawings of an alternative embodiment of the present disclosure.

Proceeding next to FIG. 5A, shown is another embodiment of the present disclosure for eliciting peak aerobic capacity or maximum oxygen consumption of a person 500. The person 500 is positioned on a belt of a treadmill. The person 500 is then fitted to a harness 503. Coupled to the harness are one or more elastic lines 506 made of rubber or a similar elastic material. The elastic lines 506 can be threaded through one or more pulleys 509 and anchored at the base of the treadmill. Further, groups of pulleys can be placed into a bank 513 of pulleys 509, as illustrated, along a slide 516. Each elastic line 506 can be tightened or stretched to develop force that is to be applied horizontally to the individual 500. Force can also be developed by moving a bank 513 of pulleys 509 along the slide 516. By using banks 513 of pulleys 509, a more constant force can be applied to the individual 500 by allowing for the position of the banks 513 of pulleys 509 to be adjusted as the individual 500 changes position on the treadmill. In some embodiments, minor deviations from the target value of the constant force may be tolerated. For example, variations of ±25 Newtons may be allowed, although variations of ±5 Newtons or less would be preferable.

Figure 5B:
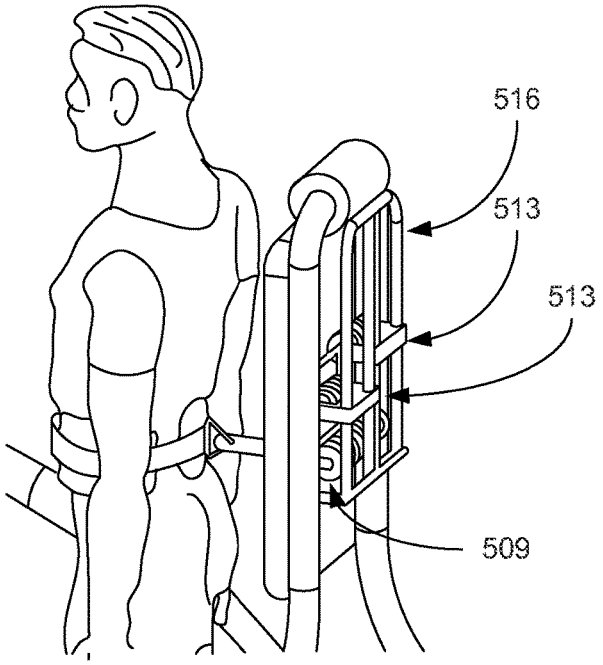

FIG. 5B depicts another view of the embodiment depicted in FIG. 5A and described above. Here, one example of the arrangement of the elastic lines, pulleys 509, and banks 513 of pulleys 509 is depicted. As shown, the banks 513 of pulleys 509 are coupled to a slide 516, allowing for the banks 513 to be repositioned as needed. Other arrangements are possible and can be utilized in various other examples or instances of the present disclosure.

Figure 6A:
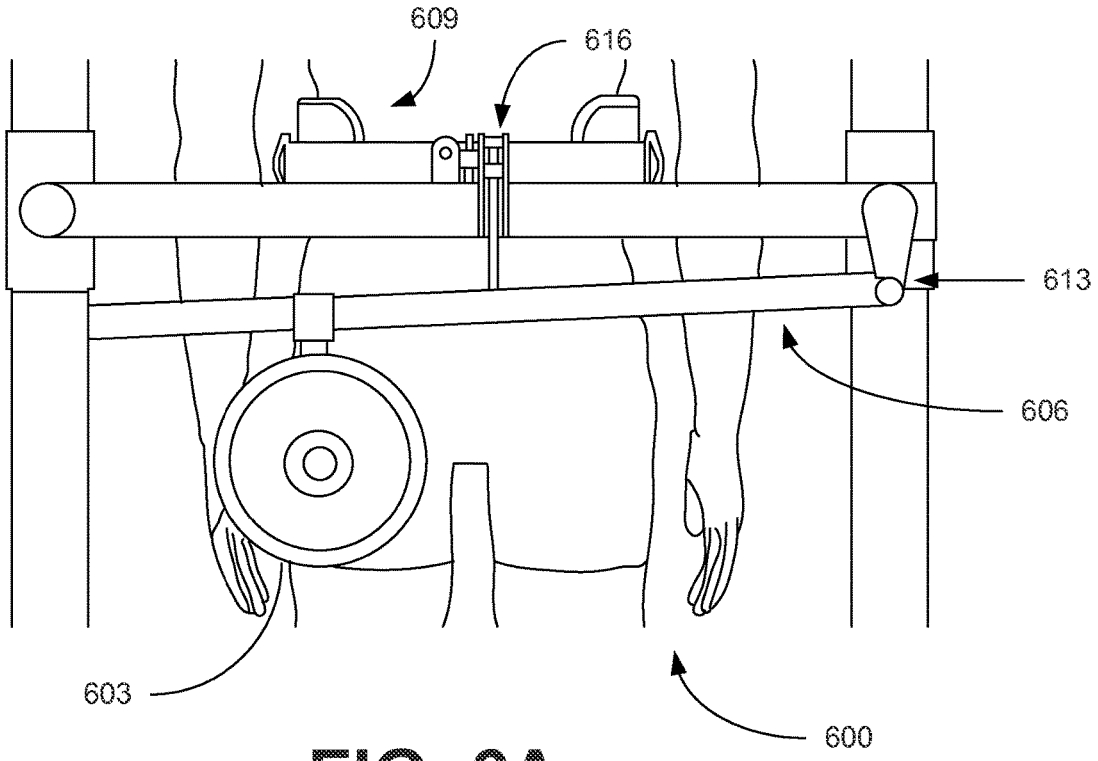
FIG. 6A and FIG. 6B are drawings of an alternative embodiment of the present disclosure.

Referring next to FIG. 6A, shown is another embodiment of the present disclosure for eliciting peak aerobic capacity or maximum oxygen consumption of a person 600. In contrast to the systems of bands and pulleys described above, FIG. 6A depicts a weight 603 suspended from a lever 606 attached to a harness 609 affixed to the individual 600. As the weight 603 is positioned closer to or farther away from the lever point 613, the force applied to the individual 600 is increased or decreased accordingly. In some embodiments, a pulley 616 is used to double the force felt by the individual 600 by wrapping a traction line around the pulley 616 at the waist of the individual.

Figure 6B:
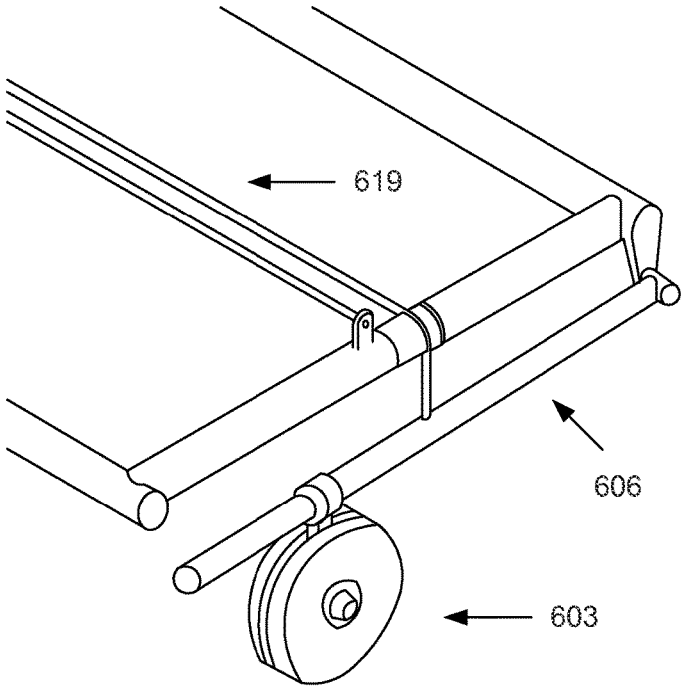

FIG. 6B shows another view of the embodiment depicted in FIG. 6A. Here, the traction line 619 is shown extending from the lever 606 to which the weight 603 is attached. Other arrangements are also possible and can be utilized in various other examples or instances of the present disclosure.

Figure 7:
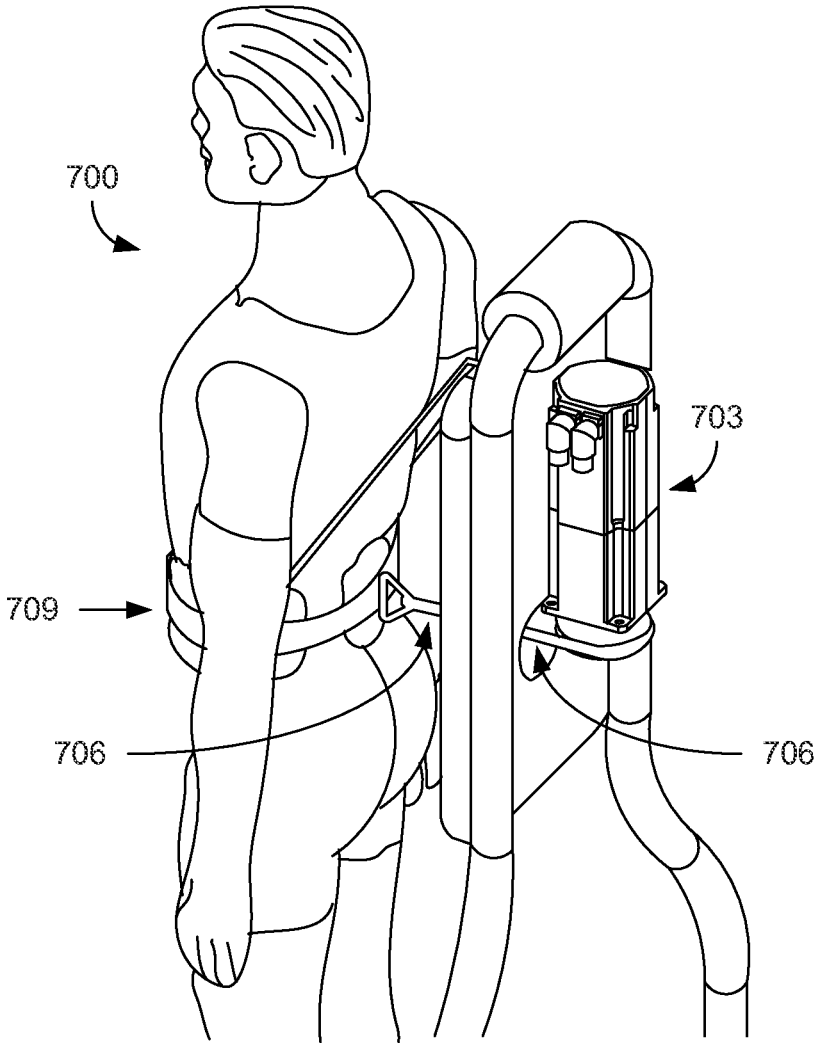
FIG. 7 is a drawing of an alternative embodiment of the present disclosure.

Moving on to FIG. 7, shown is another embodiment of the present disclosure for eliciting peak aerobic capacity or maximum oxygen consumption of a person 700. In the embodiment depicted in FIG. 7, a motor 703 that applies a constant force is connected to a traction line 706. The traction line 706 is coupled to the harness 709, which is affixed to the individual 700. In some embodiments, the traction line 706 can be coupled to the harness 709 by a spring or elastic connector. The motor 703 that applies a constant force generates a torque that is transferred to the traction line 706. The traction line 706, in turn, applies a horizontal force to the harness 709 affixed to the individual 700. The use of a motor 703 that applies a constant force mechanizes the process of providing force, in contrast to the previously described embodiments. This can allow for a constant level of force to be exerted on the individual 700 as they walk on the treadmill, regardless of the user's relative translation (i.e., forwards or backwards) on the treadmill surface.

It should be noted that other mechanical methods of applying a horizontal force to an individual on a treadmill can be employed. For example, weights can be suspended from a rotating wheel which, when rotated, changes the moment arm of the weights. The moment generated by the weights on the wheel is resisted by a compliant line to the individual on the treadmill. The line to the individual is also connected to a disc on the wheel, which increases its moment arm as the weight's moment arm decreases, and vice-versa. Turing the wheel generates the desired force by changing the relative moment arms of the weights and the traction line to the individual on the treadmill.

Additional pulleys can also be used to magnify the force applied to an individual on a treadmill. Although the use of pulleys has been depicted in the figures and described in some of the embodiments above, it is understood that any number of pulleys can be employed to increase or otherwise amplify the amount of force generated by any one of these embodiments and applied to the individual on the treadmill. Accordingly, any reference to the use of pulleys and any depiction of the use of pulleys is intended to be illustrative of the principals governing the various embodiments and is not intended to convey the use of a specific number of pulleys in any particular embodiment.

Figure 8:
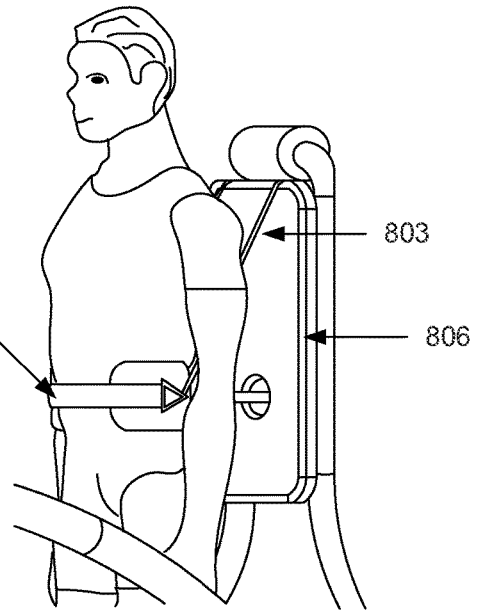
FIG. 8 is a drawing of an embodiment of the present disclosure.

Proceeding next to FIG. 8, shown is a depiction of a suspension safety system for use in various embodiments of the present disclosure. Ropes, cables, or similar supports 803 are attached to the top of the traction frame 806. The supports 803 are then attached to the harness 809. For example, the supports 803 can be clipped with swivel snaps to the harness 809. The supports 803 preferentially have some slack during ambulation of the individual, but are sufficiently tight to catch or otherwise suspend the individual if they begin to fall. In addition, the traction frame 806 prevents the individual from falling off the back of the treadmill, due to the direction of the treadmill belt and the application of the horizontal force. In addition, the traction frame 806 also provides a maximum limit of travel for the individual while using the treadmill. In some embodiments, the traction frame 806 also provides a mechanical function in the application of the horizontal force applied to the user, as well as for the safety/catching mechanism.

Figure 9A:
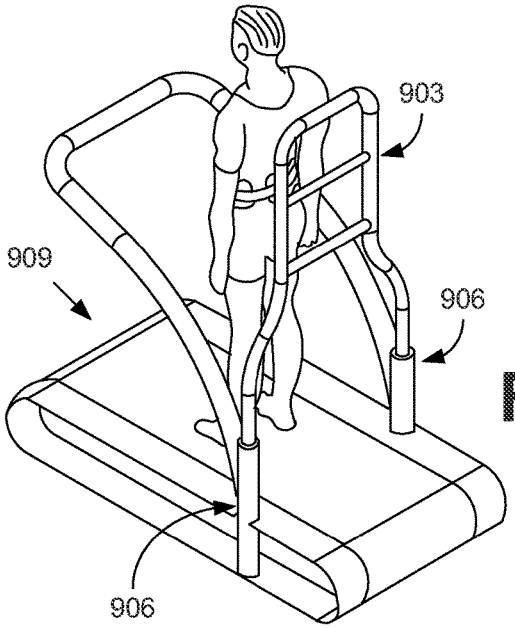
FIG. 9A and FIG. 9B are drawings of an embodiment of the present disclosure.

Referring next to FIG. 9A, shown is a depiction of a traction frame system for use in various embodiments of the present disclosure. A frame 903 plugs into vertical sockets 906 at the base of the handrails of the treadmill 909 or on the sides of the treadmill 909, depending on the configuration of the treadmill 909 itself. In the event that an individual is moving slower than the belt of the treadmill 909, the frame 903 will halt the individual's movement to the rear, preventing the individual from being hurled off of the treadmill 909.

In some embodiments, the vertical sockets 906 can include quick-release clamps or similar fasteners. In these embodiments, the vertical sockets 906 can be quickly moved along the sides of the treadmill 909 in order to position the vertical sockets 906 at or in proximity to the individuals center of mass. Positioning the vertical sockets 906 at or in proximity to the individuals center of mass increases the safety of the traction frame system.

Figure 9B:
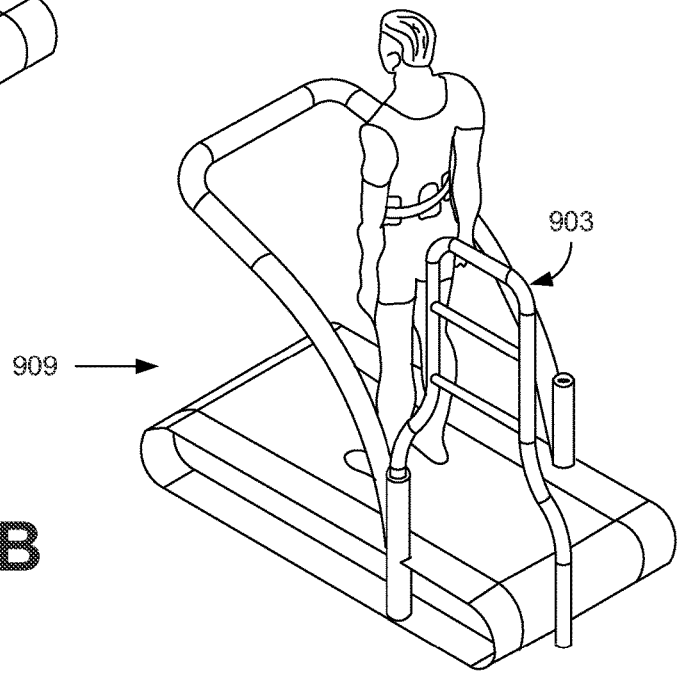

FIG. 9B depicts a mode of operation of the traction frame system depicted in FIG. 9A. As illustrated, the frame 903 can, in some embodiments, be lifted and swung to one side. This provides full access to the treadmill 909.

Figure 10:
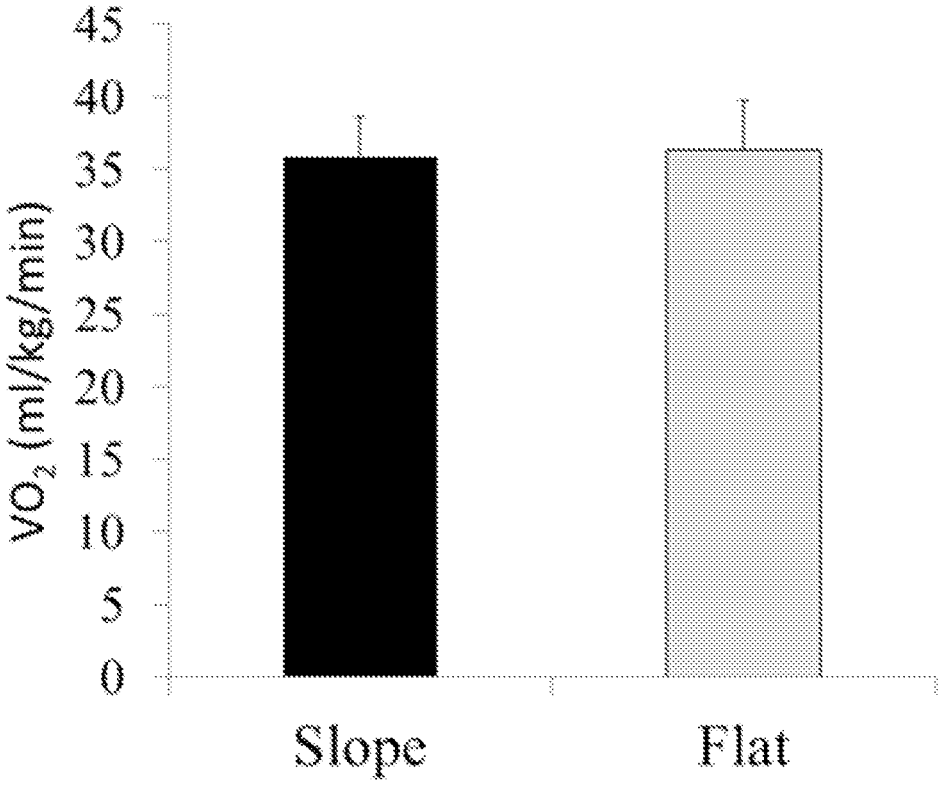
FIG. 10 is a graph illustrating the physiologic effect on an individual of the various embodiments of the present disclosure.

FIG. 10 depicts a comparison between the physiologic effort expended by an individual subject to stage 3 of the Bruce Protocol and an individual subject to one or more embodiments of the present disclosure. FIG. 10. shows that, using a prototype configured with a resistive force elements, physiological effort of an individual using horizontal resistive forces (Flat) matches the increased walking speed and treadmill slope utilized in the Bruce Protocol (Slope). In this example an individual walked at a 14% slope at 3.4 m.p.h. and 0% slope at 2 m.p.h. while experiencing 50 pounds of horizontal resistive force. The similarities in physiologic effort ($VO_2$), despite the different conditions, show an efficacy for approach of increasing physiologic work by horizontal resistive forces.

Figure 11:
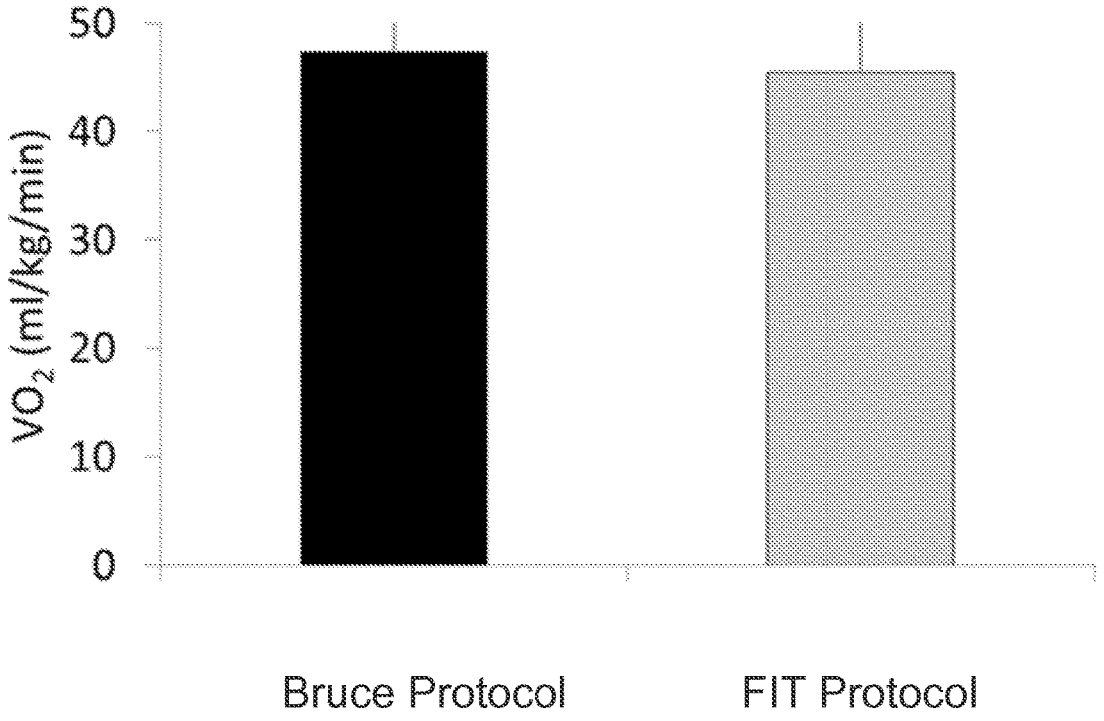
FIG. 11 is a graph illustrating the physiologic effect on individuals of the various embodiments of the present disclosure.

FIG. 11 depicts a comparison of the average peak aerobic activity of individuals subjected to the Bruce Protocol and individuals subjected to one or more embodiments of the present disclosure. In a preliminary experiment to validate various embodiments of the present disclosure (FIT Protocol), six healthy individuals completed the Bruce Protocol and the FIT Protocol. The tests were performed on two separate days: Day 1=Bruce Protocol on an inclining treadmill; Day 2=FIT Protocol on a flat treadmill.

For the FIT protocol, work rates from the Bruce Protocol were matched by applying individualized horizontal resistive forces (dependent on the individual's weight) to the volunteer's center of mass. Individuals maintained a constant walking speed of 1.3 m/s for the duration of the test, which was deemed to be a comfortable walking speed. The measured peak $VO_2$ values for both protocols are within 4% of each other.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

a treadmill;

a harness configured to transfer a constant horizontal force to a person on the treadmill, the harness being configured to prevent the person from falling onto a belt of the treadmill and the harness is connected to a lever arm, wherein a weight is suspended from the lever, or the harness is connected to an elastic line configured to develop the constant horizontal force as the elastic line is stretched;

a computing device in data communication with the treadmill and the harness, wherein the computing device is configured to at least:

identify a velocity of a belt of the treadmill;

identify a mass of the person; and calculate a work rate for the person on the treadmill based at least in part on the velocity of the belt and the mass of the person.

2. The system of claim 1, wherein the computing device is further configured to at least calculate oxygen consumption of the person on the treadmill based at least in part on the work rate.

3. The system of claim 1, wherein the treadmill further comprises an apparatus configured to permit the person to select the velocity of the belt.

4. The system of claim 1, wherein the harness is connected to a motor that applies a constant force by a traction line.

5. The system of claim 1, wherein the elastic line is threaded around a pulley mounted to a frame of the treadmill.

6. An apparatus, comprising:

a treadmill;

a frame connected to a rear portion of the treadmill;

a lever connected to the frame;

a weight suspended from the lever arm, wherein the weight is configured to be slid along the lever;

a harness configured to prevent a person from falling onto a belt of the treadmill; and a line extending from the frame, the line being coupled to a rear portion of the harness and the line being further coupled to the lever, wherein the line is configured to develop a horizontal force on the harness.

7. The apparatus of claim 6, further comprising:

a motor connected to the frame, wherein the motor is configured to apply a constant force to the line; and wherein the line is further coupled to the motor that applies the constant force.

8. The apparatus of claim 6, further comprising:

a processor;

a memory; and machine-readable instructions stored in the memory, that, when executed by the processor, cause the processor to at least:

identify a velocity of a belt of the treadmill;

identify a mass of the person; and calculate a work rate for the person on the treadmill based at least in part on the velocity of the belt and the mass of the person.

9. An apparatus, comprising:

a treadmill;

a frame connected to a rear portion of the treadmill;

a harness configured to prevent a person from falling onto a belt of the treadmill; and a line extending from the frame, the line being coupled to a rear portion of the harness and the line being anchored to the base of the treadmill, wherein the line is configured to develop a horizontal force on the harness and the line is elastic, such that as the line is stretched, additional force is applied to the harness.

10. The apparatus of claim 9, further comprising:

a motor connected to the frame, wherein the motor is configured to apply a constant force to the line; and wherein the line is further coupled to the motor that applies the constant force.

11. The apparatus of claim 9, further comprising:

a processor;

a memory; and machine-readable instructions stored in the memory, that, when executed by the processor, cause the processor to at least:

identify a velocity of a belt of the treadmill;

identify a mass of the person; and calculate a work rate for the person on the treadmill based at least in part on the velocity of the belt and the mass of the person.

* * * * *